US010581212B2

(12) United States Patent
Harte

(10) Patent No.: US 10,581,212 B2
(45) Date of Patent: Mar. 3, 2020

(54) LIGHT BULB SOCKET

(71) Applicant: SOUTHERN REAL ESTATE GROUP PTY LTD, Asquith, NSW (AU)

(72) Inventor: David Harte, Cape Town (ZA)

(73) Assignee: SOUTHERN REAL ESTATE GROUP PTY LTD, Asquith (AU)

( * ) Notice: Subject to any disclaimer, the term of this patent is extended or adjusted under 35 U.S.C. 154(b) by 0 days.

(21) Appl. No.: 16/303,022

(22) PCT Filed: May 18, 2017

(86) PCT No.: PCT/AU2017/050460
§ 371 (c)(1),
(2) Date: Nov. 19, 2018

(87) PCT Pub. No.: WO2017/197456
PCT Pub. Date: Nov. 23, 2017

(65) Prior Publication Data

US 2019/0221978 A1 Jul. 18, 2019

(30) Foreign Application Priority Data

May 18, 2016 (AU) ..... 2016901850

(51) Int. Cl.
*H01R 33/90* (2006.01)
*H01R 13/453* (2006.01)
(Continued)

(52) U.S. Cl.
CPC ..... *H01R 33/90* (2013.01); *H01R 13/4532* (2013.01); *H01R 33/09* (2013.01); *H01R 33/22* (2013.01); *H01R 13/512* (2013.01)

(58) Field of Classification Search
CPC .. H01R 33/90; H01R 13/447; H01R 13/4532; H01R 13/512
(Continued)

(56) References Cited

U.S. PATENT DOCUMENTS 5,171,292 A * 12/1992 Ortiz ..... H01R 33/20 439/253
5,823,829 A * 10/1998 Suzuki ..... H01R 33/05 439/668
(Continued)

FOREIGN PATENT DOCUMENTS

GB 2288925 B 1/1998
GB 2331405 A 5/1999
(Continued)

OTHER PUBLICATIONS

International Search Report & Written Opinion dated Aug. 16, 2017 from PCT Application No. PCT/AU2017/050460.

*Primary Examiner* — Tulsidas C Patel
*Assistant Examiner* — Peter G Leigh
(74) *Attorney, Agent, or Firm* — Innovation Capital Law Group, LLP; Vic Lin

(57) ABSTRACT

There is provided a light bulb socket comprising: a substantially cylindrical socket housing defining an open end for the insertion of a light bulb connector therein, the cylindrical socket housing defining a coaxial axis, the socket housing defining an inner comprising screw threading for screw-type engagement of a screw-type light bulb and opposing pair of bayonet channels, each bayonet channel comprising an insertion channel portion parallel to the coaxial axis and terminating in an perpendicular engagement channel for the inline insertion and twisting engagement of opposing bayonet pins of a bayonet-type bulb therein; a deflectable safety plate retained within the socket housing, the deflectable safety plate deflectable between a default position towards
(Continued)

the open end of the socket housing and a deflected position away from the open end; and electrodes within the socket housing, the electrodes comprising: a central electrode; and a pair of lateral electrodes adjacent the central electrode.

21 Claims, 8 Drawing Sheets

(51) Int. Cl.
*H01R 33/09* (2006.01)
*H01R 33/22* (2006.01)
*H01R 13/512* (2006.01)

(58) Field of Classification Search
USPC ..... 439/138
See application file for complete search history.

(56) References Cited

U.S. PATENT DOCUMENTS 5,989,070 A * 11/1999 Al-Turki ..... F21V 19/006 439/638
7,413,456 B1 * 8/2008 DiFusco ..... H01R 33/22 439/253
8,668,504 B2 * 3/2014 Cofini ..... H01R 33/0836 439/101
9,210,779 B2 * 12/2015 Bosua ..... H05B 37/0245
9,876,326 B1 * 1/2018 Page ..... H01R 33/22

FOREIGN PATENT DOCUMENTS

WO 2002084814 A1 10/2002
WO 2008142624 A1 11/2008

* cited by examiner

LIGHT BULB SOCKET

FIELD OF THE INVENTION

This invention relates generally to lightbulb sockets. More particularly, this invention relates to lightbulb socket able to mechanically and electrically interface both screw-type and bayonet-type lightbulbs and, in embodiments, also downlight-type lightbulbs. Furthermore, in embodiments, the invention comprises a safety mechanism for electrically isolating the electrodes within the socket.

BACKGROUND OF THE INVENTION

Lightbulb connectors predominately comprise the screw-type "Edison" type (such as the E26 and/or E27 type lightbulbs) and bayonet-type lightbulbs (such as a 22 mm diameter bayonet-type lightbulb).

The screw-type type connector is characterised in comprising a central distal electrode electrically isolated from a peripheral threaded screw-defining electrode. The bayonet-type connector is characterised in comprising a pair of distal bayonet electrodes.

Given that these types of lightbulb connectors are often times sold even within the same country, it would be desirous to have a light socket able to mechanically and electrically interface both types of lightbulb connectors.

However, frustratingly, the different types of connectors pose challenges both in terms of mechanical engagement (wherein the screw-type connector requires screw-type mechanical engagement and wherein the bayonet-type connector comprises bayonet mechanical engagement of laterally projecting bayonet retention pins) but also in terms of electrical connection (wherein the screw-type connector requires electrical connection of the central distal and lateral electrodes whereas the bayonet-type connector requires electrical connection of the distally adjacent pair of electrodes).

Furthermore, new types of lightbulb connectors are entering the market, including the downlight-type connector (such as the GU10-type connector), predominantly being utilised for energy-efficient lighting.

It would be desirous to have a lightbulb socket also able to engage the downlight-type connector also.

Furthermore, it would be desirous to have a lightbulb socket that is safe, including despite the plurality of mechanical and electrical connections, in reducing or preventing electrocution when inserting one's fingers or other foreign object within the light socket when the light socket is live.

The present invention seeks to provide a light socket, which will overcome or substantially ameliorate at least some of the deficiencies of the prior art, or to at least provide an alternative.

It is to be understood that, if any prior art information is referred to herein, such reference does not constitute an admission that the information forms part of the common general knowledge in the art, in Australia or any other country.

SUMMARY OF THE DISCLOSURE

In the embodiments of that follow, there is provided a lightbulb socket able to connect both the screw-type and bayonet-type lightbulb connectors.

Specifically, the lightbulb socket comprises a central electrode and adjacently located lateral electrodes within the socket. As such, the lateral electrodes form electrical connections with bayonet electrodes and the central electrode, in conjunction with a side connector strip, forms and electrical connection with the distal and lateral electrodes of a screw-type lightbulb connector.

Furthermore, the lightbulb socket comprises a safety feature in the form of a deflectable safety plate which conceals the electrodes when not in use. The insertion of a lightbulb into the light socket deflects the applicable safety plate downwardly, thereby exposing the electrodes for electrical connection. In an embodiment, the safety feature comprises a retention mechanism which retains the safety plate in a default position when not in use so as to prevent displacement therefrom by one's finger or other foreign object. In accordance with this embodiment, the deflectable safety plate may only be deflected downwardly via the insertion of a screw-type or bayonet-type connector.

Furthermore, in embodiments, the lightbulb socket is configured for electrically connecting downlight-type connectors also.

As such, with the foregoing in mind, in accordance with one aspect, there is provided a light bulb socket comprising: a substantially cylindrical socket housing defining an open end for the insertion of a light bulb connector therein, the cylindrical socket housing defining a coaxial axis, the socket housing defining an inner comprising screw threading for screw-type engagement of a screw-type light bulb and opposing pair of bayonet channels, each bayonet channel comprising an insertion channel portion parallel to the coaxial axis and terminating in an perpendicular engagement channel for the inline insertion and twisting engagement of opposing bayonet pins of a bayonet-type bulb therein; a deflectable safety plate retained within the socket housing, the deflectable safety plate deflectable between a default position towards the open end of the socket housing and a deflected position away from the open end; electrodes within the socket housing, the electrodes comprising: a central electrode; and a pair of lateral electrodes adjacent the central electrode; wherein: when the deflectable safety plate is at the default position, the electrodes are electrically isolated from the open end beneath the safety plate and when a light bulb connector is inserted into the open end, the deflectable safety plate is deflected towards the deflected position such that the electrodes protrude through the safety plate to form an electrical connection with the light bulb connector.

For a bayonet-type connector comprising a pair of bayonet electrodes, the lateral electrodes may respectively electrically connect with the bayonet electrodes.

For a screw-type connector comprising a distal electrode and a peripheral screw defining electrode, the lightbulb socket may further comprise a side connector strip electrically connected to one of the lateral electrodes, the side connector strip reaching within the screw threading such that the central electrode electrically connects the distal electrode and the side connector strip electrically connects the peripheral screw defining electrode.

The side connector strip may be recessed within the screw-type threading for electrical isolation.

An upper terminus of the side connector strip may be concealed by the safety plate when the safety plate is in the default position.

The light bulb socket may further comprise a retention mechanism for retaining the safety plate in the default position and wherein inserting the lightbulb connector into the socket housing causes the disengagement of the retention mechanism.

The retention mechanism may comprise a plurality of safety retention fingers gripping a periphery of the safety plate and an activation sleeve above the safety plate such that insertion of the lightbulb connector into the socket contacts the activation sleeve thereby causing the activation sleeve to move towards the safety plate to disengage the safety retention fingers so as to allow the safety plate to move towards the deflected position in turn.

The activation sleeve may comprise a plurality of disengagement wedges corresponding to the plurality of safety retention fingers and wherein, when the activation sleeve moves towards the safety plate, the disengagement wedges wedge between the safety fingers and the periphery of the safety plate so as to prise the safety fingers away from the peripheral edge of the safety plate.

The retention fingers may comprise inwardly facing catches which catch on and undersurface edge of the safety plate when the safety plate may be in the default position.

Each safety finger may comprise a pair of adjacent catches defining a gap therebetween for accommodating a respective disengagement wedge.

The deflectable safety plate may be biased towards the default position and wherein each catch may be angled at an undersurface thereof so as to allow the safety plate to push upwardly past the catch to the default position.

The safety plate may comprise a central bore for the central electrode and a pair of lateral bores adjacent the central bore for the lateral electrodes and wherein, when the safety plate may be deflected to the deflected position, the electrodes protrude through the bores.

The lateral bores are shaped for the rotational engagement of a downlight-type connector comprising a pair of distal downlight electrodes, each electrodes comprising a stem terminating in a head of greater diameter and wherein each lateral bore may comprise a major bore portion for the insertion of the head therethrough and a rotationally offset minor bore portion for the engagement of the stem and the engagement of the head there underneath.

The lateral electrodes electrically connect the downlight electrodes when the downlight electrodes are located within the respective minor bore portions.

Other aspects of the invention are also disclosed.

BRIEF DESCRIPTION OF THE DRAWINGS

Notwithstanding any other forms which may fall within the scope of the present invention, preferred embodiments of the disclosure will now be described, by way of example only, with reference to the accompanying drawings in which.

DESCRIPTION OF EMBODIMENTS

Figure 1:
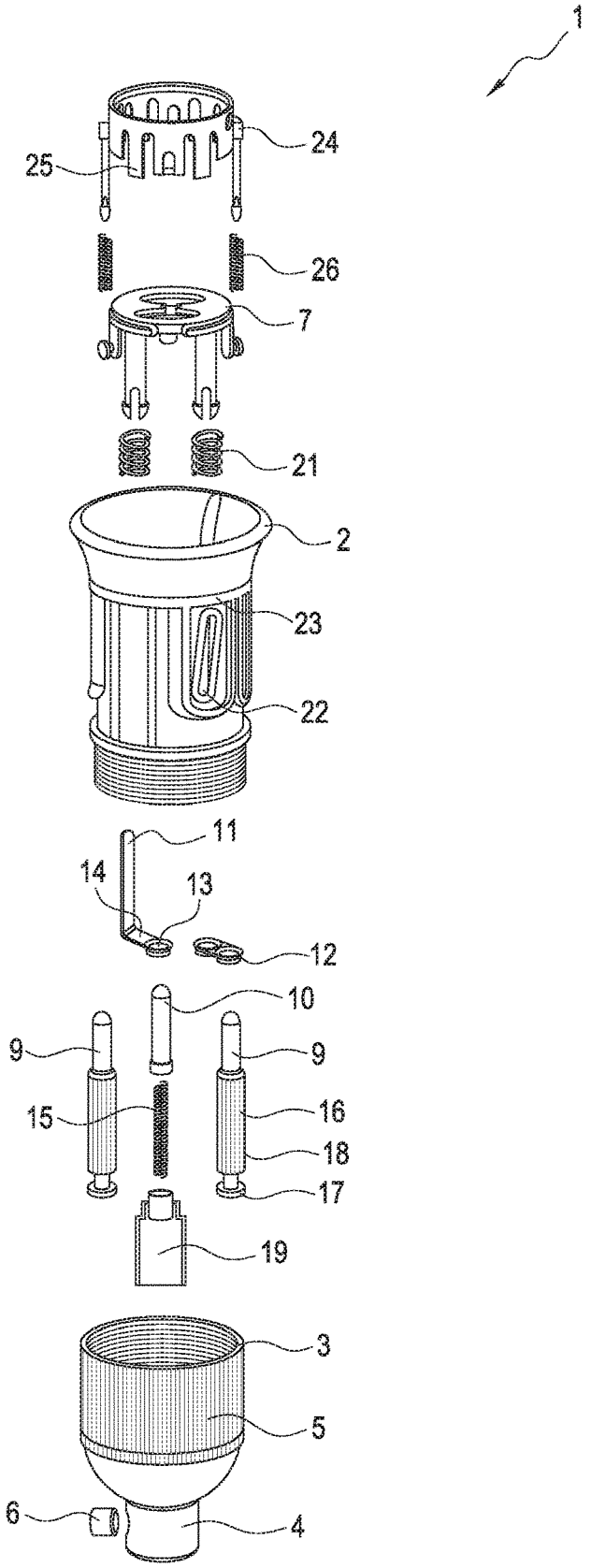
FIG. 1 shows an exploded view of a lightbulb socket in accordance with an embodiment.

FIG. 1 shows an exploded representation of a lightbulb socket 1. The socket 1 comprises a socket housing 2 which screws into an end cover 3.

Orientation will be described with reference to an imaginary coaxial axis passing vertically through the socket housing 2 given the orientation of the socket 1 in FIG. 1.

The inner of the socket housing 2 defines screw threading for screw-type engagement of a screw-type lightbulb. Furthermore, the inner of the socket housing 2 defines opposing bayonet channels, each channel comprising an insertion channel portion parallel to the coaxial axis and terminating in an engagement channel portion substantially perpendicular the coaxial axis for the in-line insertion and twisting engagement of opposing bayonet pins of a bayonet-type lightbulb therein.

As such, the screw threading and the bayonet channels allow for the engagement of both screw-type and bayonet-type lightbulbs by the socket housing 2.

The end cover 3 terminates in a wiring sleeve 4 through which electrical wiring may be reticulated. The end cover 3 may comprise a gripping surface 5 for facilitating the screwing of the socket housing 2 into the end cover 3. A wiring retainer screw 6 may protrude into the wiring sleeve 4 to engage the electrical wiring therein and prevent pulling therefrom.

The socket 1 further comprises a deflectable safety plate 7 which locates within the socket housing 2. As will be described in further detail below, the deflectable safety plate 7 is deflectable from a default not-in-use position and a deflected in-use position when a screw-type or bayonet-type lightbulb is inserted into the socket housing 2.

The deflectable safety plate 7 selectively exposes electrodes when deflected thereby conferring safety to the socket 1. The deflectable safety plate 7 may be biased towards the default position by way of biasing mechanism, such as one comprising compression springs 21.

The socket 1 further comprises electrodes for forming electrical connections with the lightbulb connector electrodes when inserted within the socket 1.

For the electrical connection of bayonet-type lightbulbs (and downlight-type lightbulbs in an embodiment provided in further detail below), the electrodes comprise a pair of lateral electrodes 9.

For the electrical connection of screw-type lightbulbs, the electrodes further comprise a central electrode 10 and a side connector strip 11.

The inferior ends of the lateral electrodes 9 may comprise screw-type electrical engagements comprising a barrel 16 into which a screw 17 is screwed in-line so as to enclose a lateral aperture 18 for containing an end of a respective electrical wire.

An electric bridge 12 having respective apertures therein may be utilised for electrically connecting one of the lateral electrodes 9 and the central electrode 10. As such, the central electrode 10 shares polarity with one of the lateral electrodes 9.

A side connector strip 11 may provide electrical contact of the for the lateral electrodes of the screw-type bulb.

The side connector strip 11 may comprise an elbow 14 terminating at an aperture 13 at the distal end thereof for forming an electrical connection with the other lateral electrode 9. As such, the side connector strip 11 shares polarity with the other lateral electrode 9 and therefore the central electrode 10 and side connector strip 11 have opposite polarity.

As such, the utilisation of the bridge 12 and the side connector strip 11 requires only the wiring of the electrical wiring to the inferior screw-type electrical engagements of the lateral electrodes 9 within the end cover 3.

A divider 19 may locate between the screw-type electrical engagements at the inferior ends of the lateral electrodes 9 so as to prevent or reduce the likelihood of shorting therebetween.

In embodiments, the lateral electrodes 9 and the central electrode 11 may take the firm of pogo pins parallel with the coaxial axis. The pogo pins may be biased towards the open end by compression springs 15.

Furthermore, the divider 19 may comprise a superior opening 20 for receipt of an inferior end of a central compression spring 15 of the central electrode 10.

In a preferred embodiment, the socket housing 2 comprises a retention mechanism for retaining the safety plate 7 at the default position.

In embodiments, the retention mechanism comprises deflectable retention fingers 22 which hold the deflectable safety plate 7 in the default position. In the embodiment shown in FIG. 1, the deflectable safety fingers 22 are elongate, are arranged parallel the coaxial axis and comprise a live hinge 23 towards the open end.

The inner distal ends of the fingers 22 comprise catches 43 which grip the periphery of the safety plate 7 so as to hold the safety plate 7 in the default position so as to prevent the inadvertent deflection thereof, with one's finger or other foreign object for example and the unsafe exposing of the electrodes.

Furthermore, in accordance with this embodiment, the socket 1 may further comprises an activating sleeve 24 located within the socket housing 2 above the safety plate 7. The activation sleeve 24 comprises disengagement wedges 25 which each wedge wedges between the safety fingers 22 and the periphery of the safety plate 7 thereby prising the safety fingers 22 away from the periphery of the safety plate 7 so as to release the safety plate 7.

As will be described in further detail below, the insertion of a lightbulb connector into the socket housing 2 causes the activation sleeve 24 to move downwardly towards the safety plate 7 so as to disengage the safety plate 7 to expose the electrodes. The activation sleeve 24 may similarly be deflectable between a default and deflected positions and biased towards the default position by way of a biasing mechanism, such as one comprising compression springs 26. The activation sleeve 24 may comprise an inner profile having a narrower diameter as compared to that of an outer periphery of the lightbulb connector so as to catch against the connector and be borne downwardly into the socket housing 2 when a lightbulb connector is inserted into the open end.

As can be seen, the activation sleeve compression strings 24 may be or smaller dimension and therefore less resilient as compared to those of safety plate compression springs 21 so as to cause the activation sleeve 24 to locate adjacent the safety plate 7 and therefore allow for operation of the wedges 25 when force is applied thereto.

Figure 2:
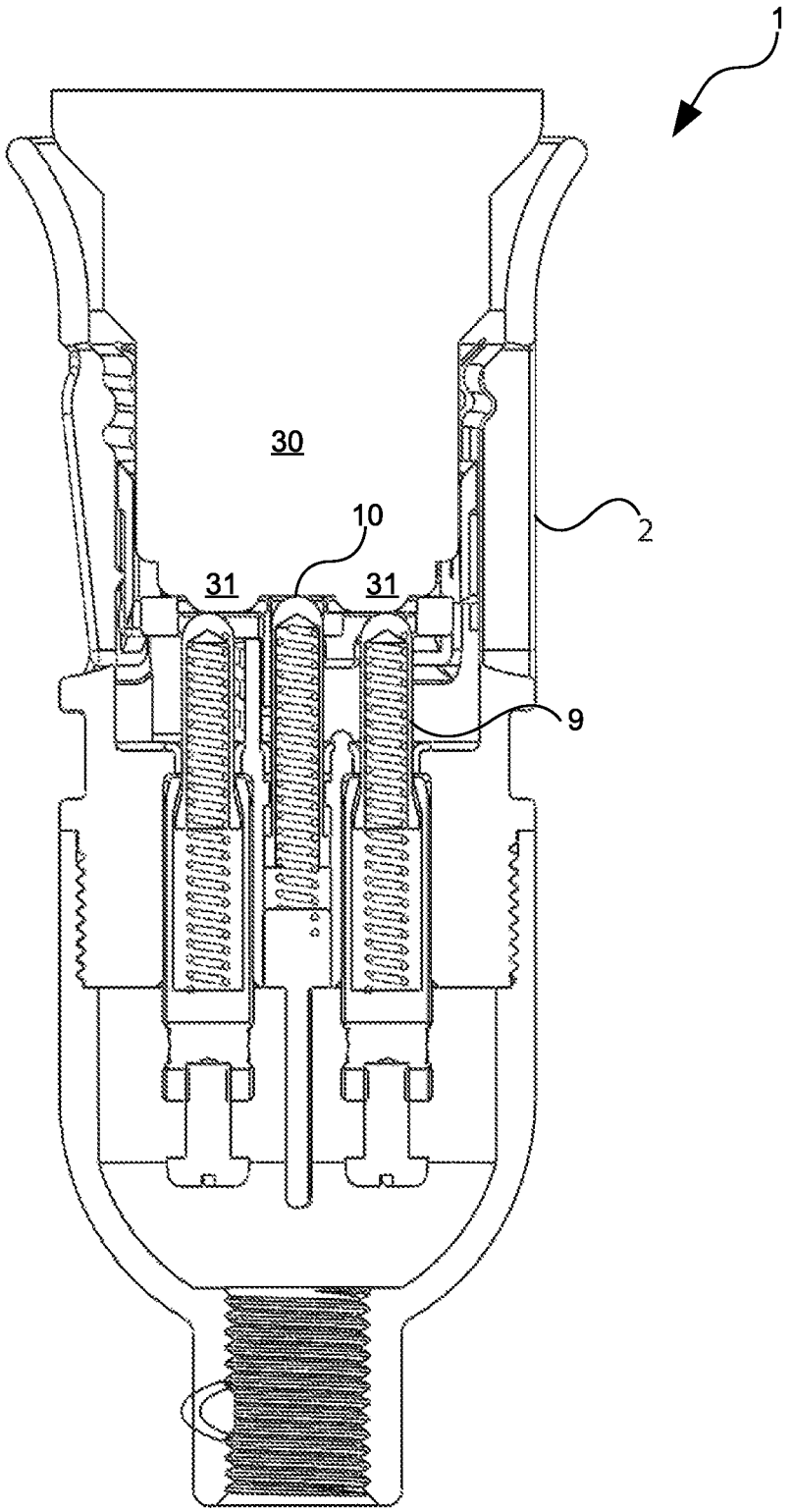
FIG. 2 shows a side elevation cross-sectional view of the lightbulb socket engaging a screw-type lightbulb connector in accordance with an embodiment.

FIG. 2 show the engagement of a screw-type lightbulb connector 27 within the socket 1. As can be seen, the screw-type connector 27 is characterised in comprising a central distal electrode 28 electrically isolated from a lateral peripheral electrode 29, the peripheral electrode 29 also defining the threading of the connector 27.

As is shown in FIG. 2, the insertion of the screw-type connector 27 into the socket 1 engages the activation sleeve 27 so as to cause the activation sleeve 27 to move down into the socket housing 2 towards the safety plate 7 until such time that the disengagement wedges 25 prise the safety retention fingers outwardly so as to release their grip on the periphery of the safety plate 7.

Once the safety plate 7 is released in this manner, the safety plate 7 itself moves down within the socket housing 2 towards the deflected position until such time that the central electrode 10 protrudes through a central bore of the safety plate 7 so as to form an electrical contact with the distal electrode of the screw-type connector 27.

Substantially simultaneously, the peripheral electrode 29 of the screw-type connector 27 makes contact with the side connector strip 11 so as to complete the electrical circuit.

Figure 3:
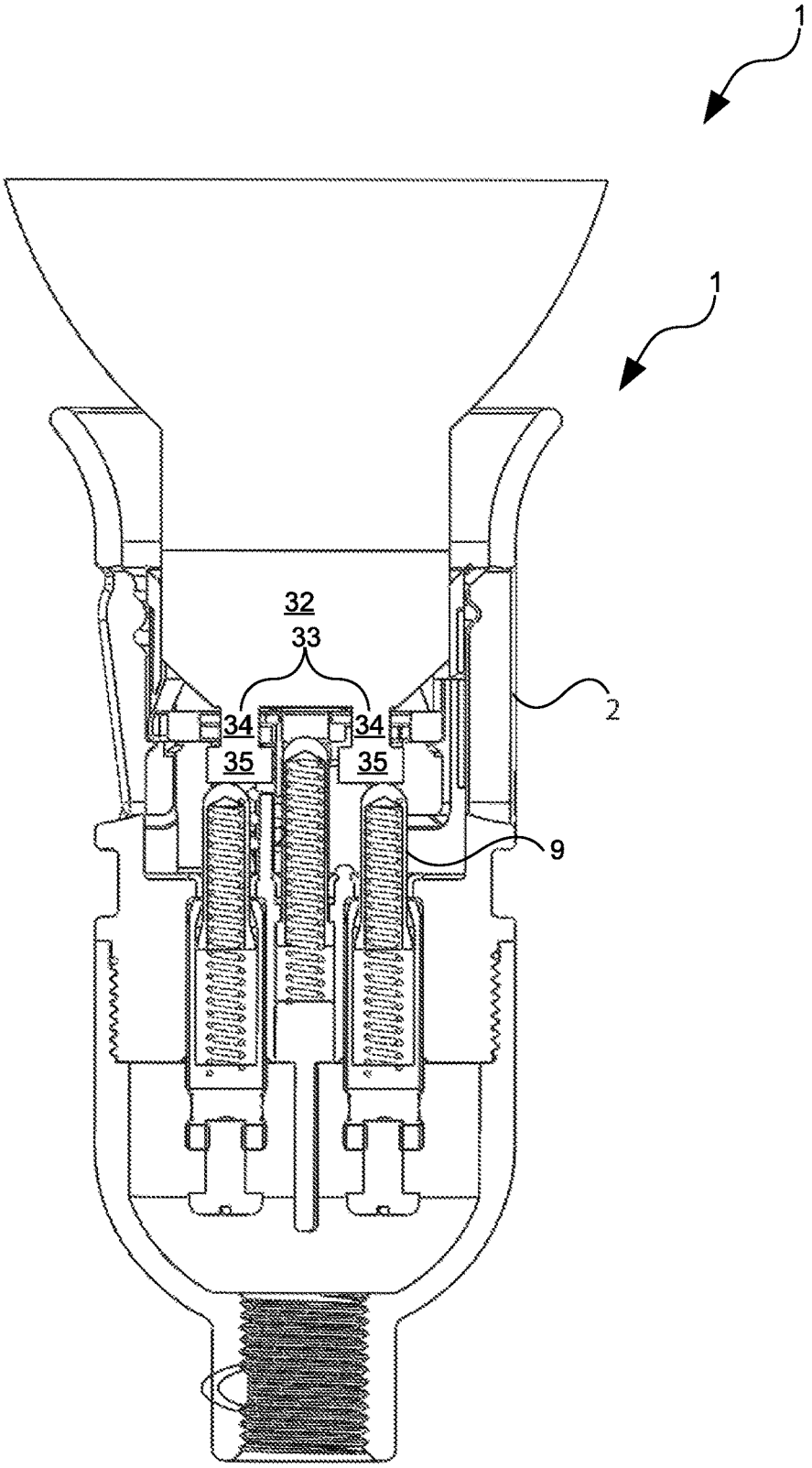
FIG. 3 shows a cross-sectional elevation view showing the light socket connecting a bayonet-type lightbulb connector in accordance with an embodiment.

Turning now to FIG. 3, there is shown an example wherein a bayonet-type connector 30 is engaged within the socket 1. As can be seen, the bayonet-type connector 30 is characterised in comprising a pair of distal facing electrodes 31.

In a similar manner, the insertion of the bayonet-type connector 30 into the socket 1 again catches the activation sleeve 24 thereby forcing the activation sleeve 24 downwardly within the socket housing 2 such that the disengagement wedges 25 prize the safety retention fingers 22 away from the periphery of the safety plate 7 so as to, in turn, allow the safety plate 7 to move downwardly until such time that the lateral electrodes 9 protrude through respective bores of the safety plate 7 so as to make contact with the bayonet electrodes 31, thereby completing the electrical circuit.

As can be also seen, the central electrode 10 itself also protrudes through the safety plate 10 but harmlessly contacts an insulated region between the bayonet lightbulb electrodes 31 thereby not interfering with the electrical circuit.

Figure 4:
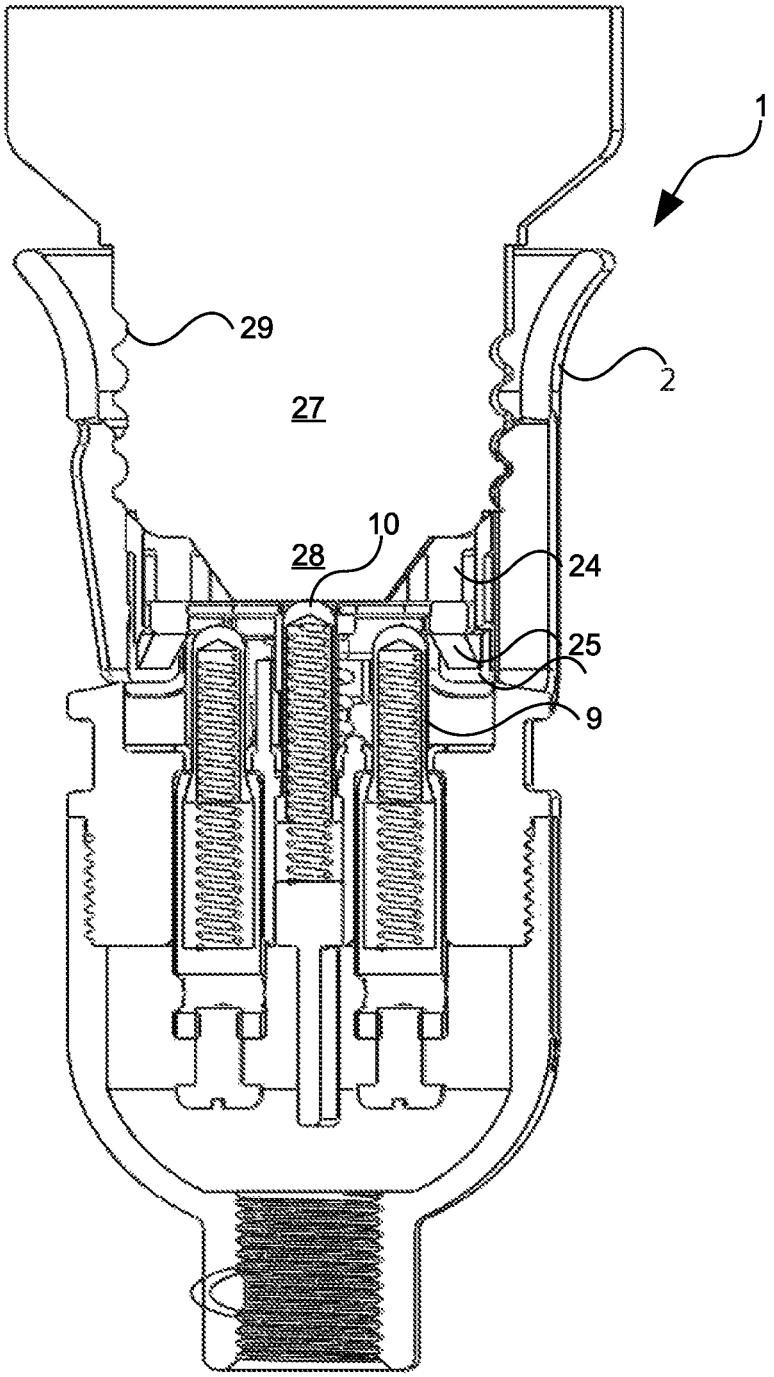
FIG. 4 shows a side cross-sectional elevation view showing the light socket connecting a downlight-type.

In a preferred embodiment, the socket 1 is further configured for accommodating a downlight-type connector 32 as a substantially shown in FIG. 4.

As can be seen, the downlight-type connector 32 is characterised in comprising a pair of distal electrodes 33 each comprising a stem 34 and a head 35 of larger diameter. In this embodiment, the safety plate 7 is not configured for downward deflection but rather wherein the downlight-type electrodes 33 are able to insert through the safety plate 7 for subsequent rotational offset for retention and making electrical contact with the lateral electrodes 9 as will be described in further detail with reference to FIG. 8 below.

As can be seen, the downlight-type electrodes 33 form electrical connections with the lateral socket electrodes 9 thereby completing the electrical circuit. As can be also seen from FIG. 4, the central socket electrode 10 locates between the downlight-type electrodes 33, thereby not interfering with the electrical circuit.

Figure 5:
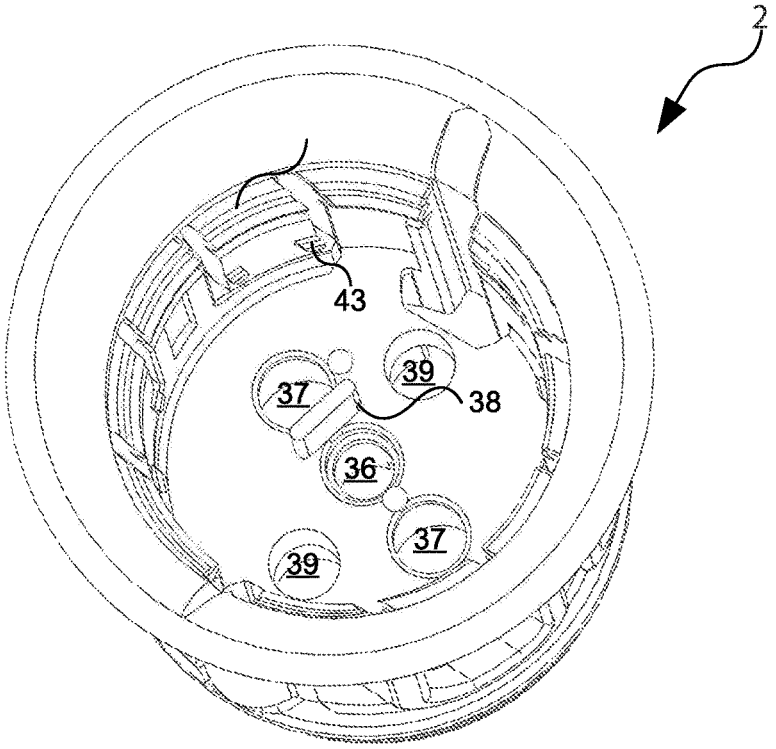
FIGS. 5 and 6 show top perspective views of a socket housing in accordance with an embodiment.
Figure 8:
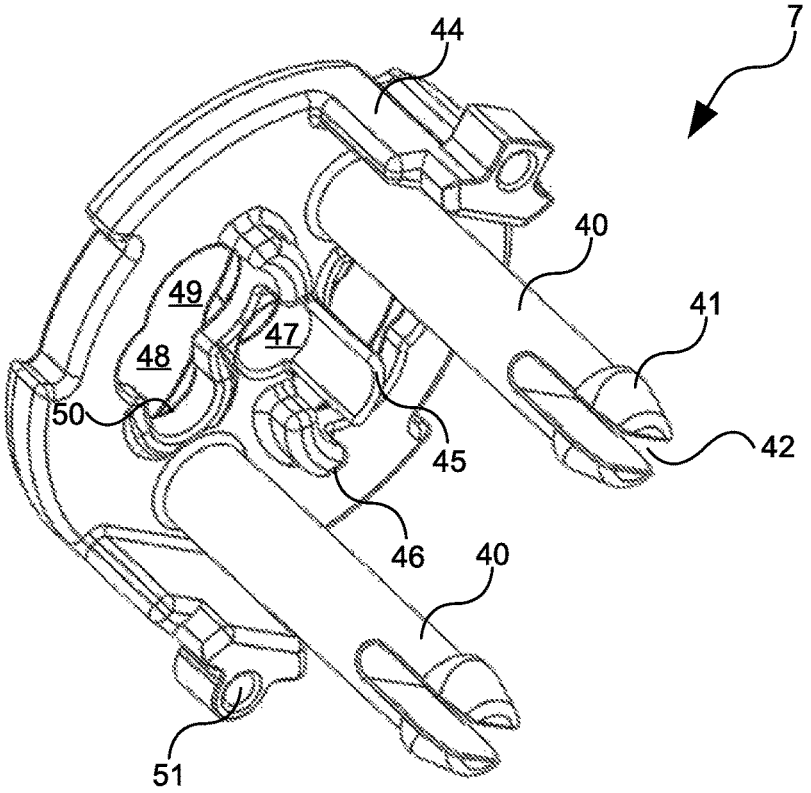
FIGS. 8 and 9 show respect of bottom and top perspective views of a safety plate in accordance with an embodiment.
Figure 9:
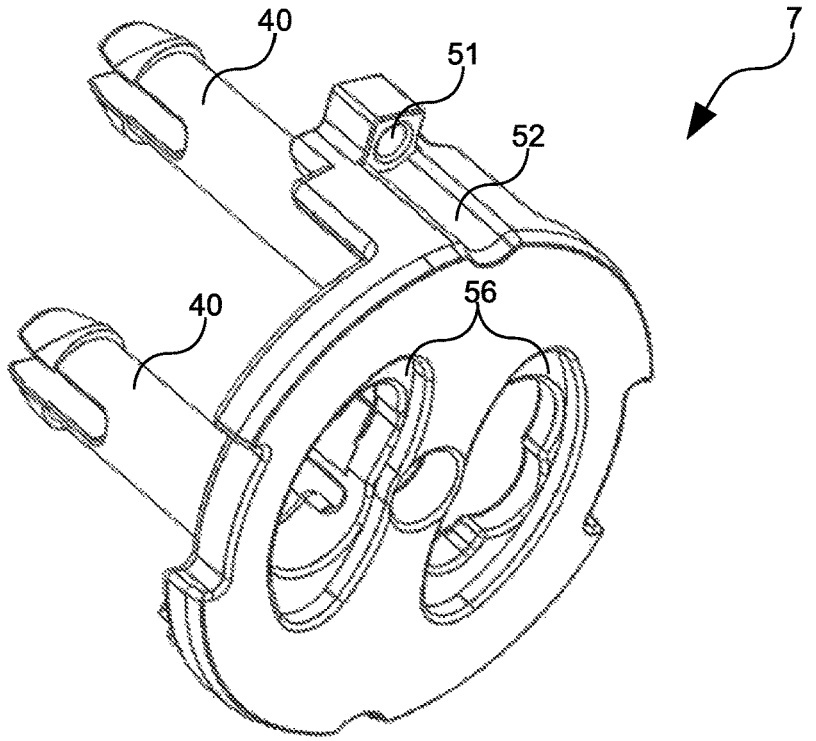

Turning now to FIG. 5, there is shown a top perspective view of the socket housing 2 in further detail with the electrodes 9, 10 and associated bridge 12 and side connector 11 having been removed. Such will be described with reference to FIGS. 8, 9 showing the applicable safety plate 7 in bottom and top perspective views respectively.

As is shown in FIG. 5, the base of the socket housing 2 comprises a central electrode bore 36 and adjacent lateral electrode bores 37. An isolation bridge 38 may be provided between the central bore 36 and one of the lateral electrode bores 37 for electrical isolation. Furthermore, the base further defines a pair of guide shaft bores 39 for the slidable receipt of guide shafts 40 of the safety plate 7 there through. As is shown in at least FIG. 8, the distal ends of the guide shafts 40 may each comprise arrowhead bosses 41 and a dividing compression cut out 42 therebetween for facilitating the insertion of the distal ends through the guide shaft bores 39 during assembly and the retention therein during use.

FIG. 5 further shows the safety retention fingers 22 in further detail wherein, in the embodiment shown, the socket housing 2 comprises four safety retention fingers 22. Each safety retention FIG. 22 may define a pair of catches 43 which catch under the peripheral edge of the safety plate 7 when the safety plate 7 is in the default position. Each catch 43 may be angled at a lower edge thereof so as to allow the safety plate 7 to travel upwardly past the catch 43, deflecting the fingers 22 laterally out of the way, to assume the default position.

However, the upper edge of each catch 43 may be substantially flat (perpendicular the coaxial axis) so as to prevent the safety plate 7 from pushing past the catch when depressed.

Each safety retention FIG. 22 may comprise a pair of spaced apart catches 43 so as to allow space for the safety wedges 7 to fit therebetween.

Figure 6:
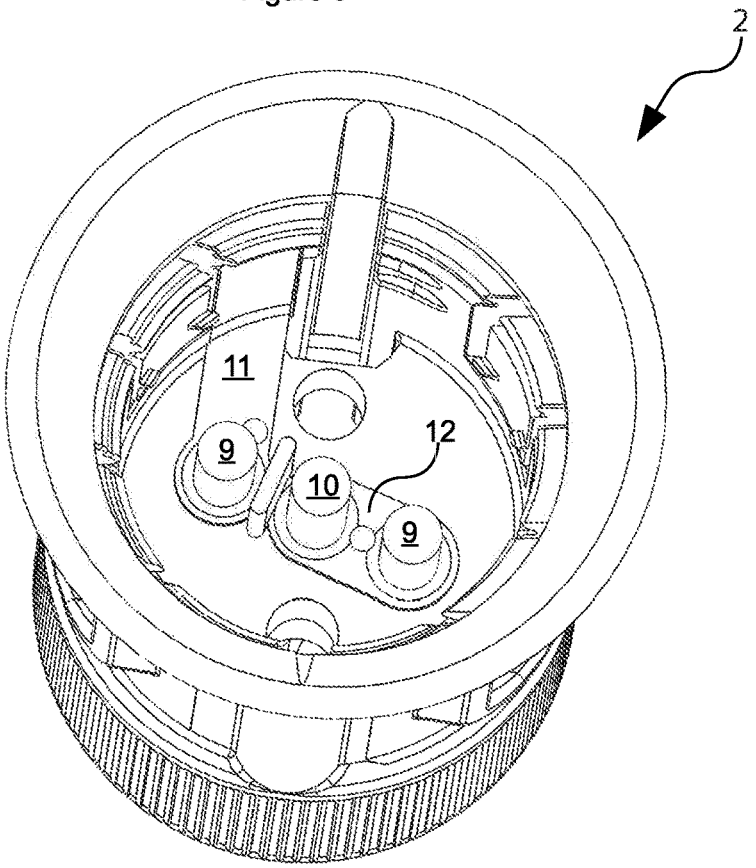

FIG. 6 shows the socket housing 2 having the electrodes 9, 10, electrical connection bridge 12 and side connector strip 7 having been inserted therein. As can be appreciated from at least FIG. 6, the upper end of the side connector strip 11 is concealed behind the inner edge of the screw-type threading so as to reduce the likelihood of contact were a finger inserted into the socket housing 2. Furthermore, the concealment of the side connector strip 7 within the threading, prevents the electrical connection of the side connector strip with lateral edges of the bayonet-type connector.

In an embodiment, the upper surface of the safety plate 7 locates above the upper terminus of the side connector strip 11 in the default position so as to only expose the inner face of the side connector strip 11 for electrical contact as the safety plate 7 moves downwardly towards the deflected position.

Considering specifically the safety plate 7 as is substantially represented in FIG. 8, 9, the safety plate 7 may comprise bottom out stops 44 to limit the downward motion of the safety plate 7. Furthermore, the safety plate 7 may comprise a pogo pin divider 45 for enhancing the electrical isolation between the central electrode 10 and an adjacent lateral electrode 9 of differing polarity.

Furthermore, the safety plate 7 may comprise downlight pin anti-reverse protrusion 46 for preventing the rotation of the downlight-type electrodes 33 in the incorrect direction.

The safety plate 7 similarly comprises a central bore 47 through which the central electrode 10 protrudes. Furthermore, the safety plate 7 comprises lateral cutout profiles adjacent the central bore 47 each defining a lateral electrode bore portion 48 and major 49 and minor 50 downlight-type electrode bores.

When utilising a bayonet-type lightbulb, the lateral electrodes 9 protrude through the lateral electrode bore portion 48. For the engagement of a downlight-type lightbulb, the respective heads 35 of the downlight-type electrodes 33 initially locate through the major bore portions 49 wherein, as the downlight-type lightbulb is rotated, the electrodes correspondingly rotate such that the electrode stems 34 move into the minor electrode bore portion 50 so as to retain the electrodes 33 therein.

Figure 7:
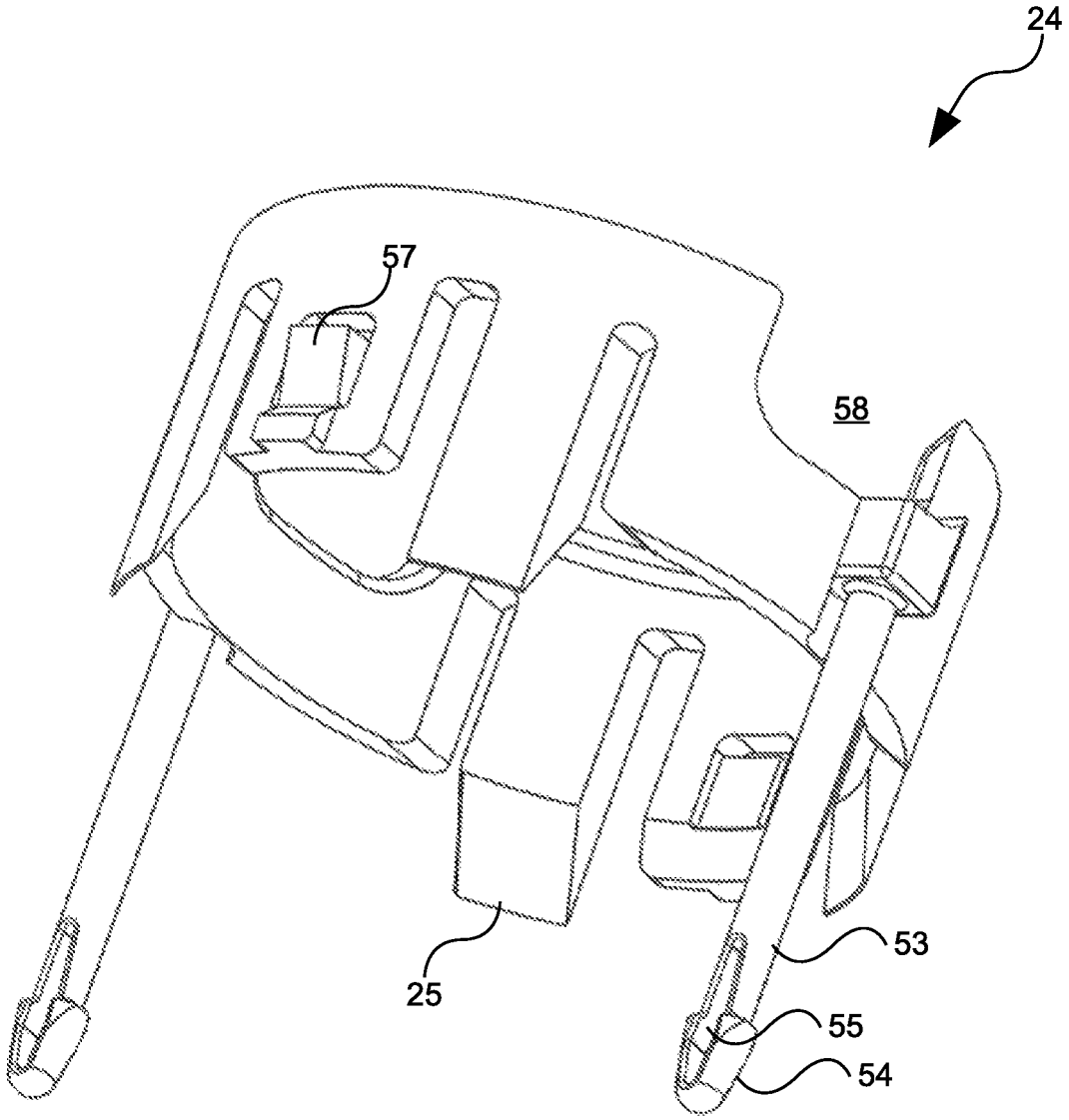
FIG. 7 shows an underside perspective view of an activation sleeve in accordance with an embodiment.

Furthermore, the safety plate 7 may comprise opposing activation plate guide pin bores 51 and compression spring reliefs 52 thereabove. FIG. 7, shows the activation sleeve 24 in further detail comprising a pair of opposing guide pins 53 which locate within the activation plate guide pin bores 51. Similarly, the distal ends of the opposing guide pins 53 terminate in arrowhead bosses having a compression channel cutouts 55 therebetween to facilitate the insertion of the distal ends of the guide pins 53 through the activation plate guide pin bores 51 during assembly and the retention therein during use.

As is shown in FIG. 9, the upper surface of the safety plate 7 may comprise a pair of recesses 56 for seating the bayonet electrodes 31.

Turning again to FIG. 7, the activation sleeve 24 may comprise top and bottom stops 57 which travel within inner reliefs 65 (as is substantially shown in FIG. 5) to retain the activation sleeve 24 within the socket housing 2. Furthermore, the activation sleeve 24 may comprise opposing bayonet pin reliefs 58 for accommodating the laterally projecting engagement pins of a bayonet lightbulb.

Figure 10:
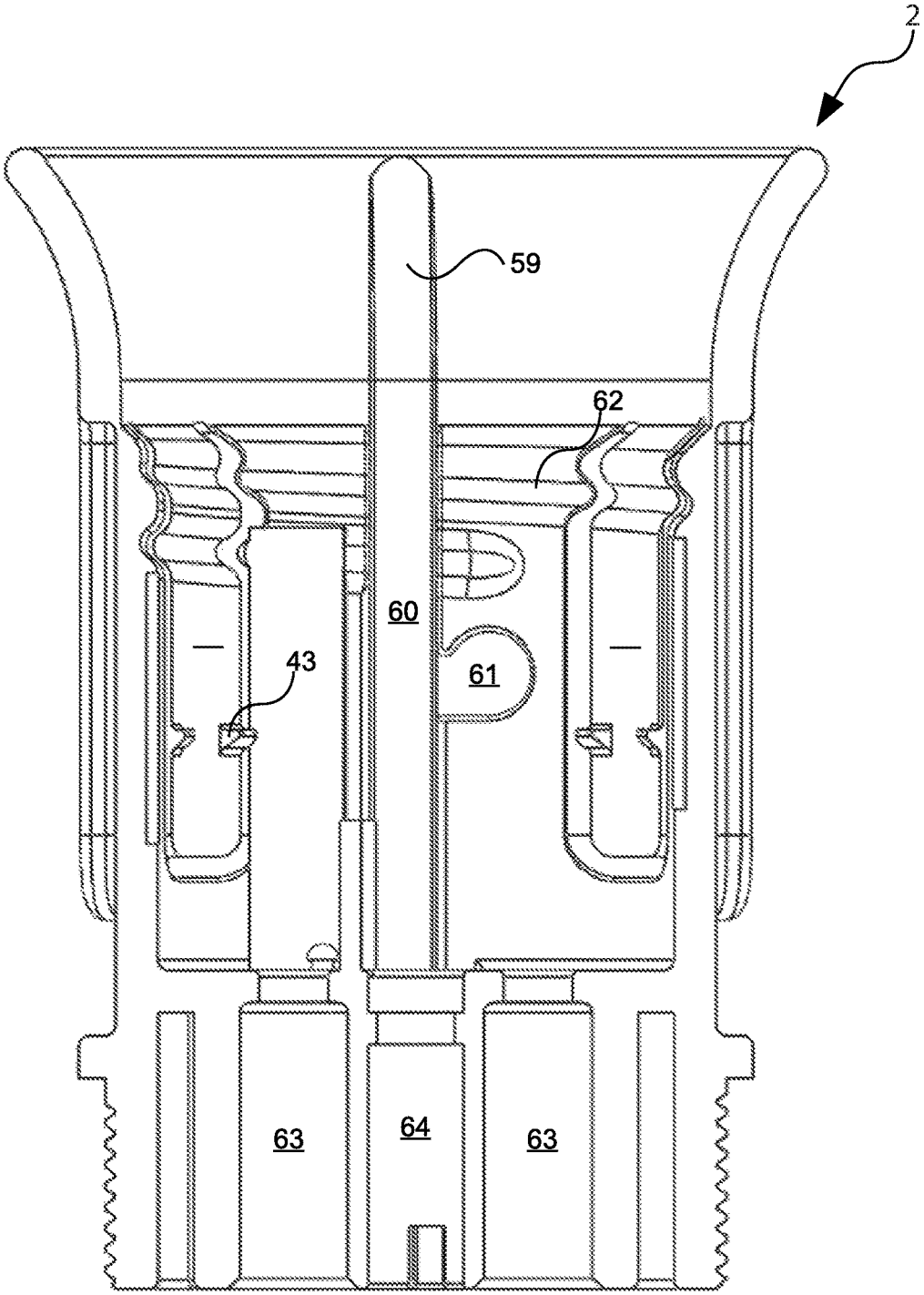
FIG. 10 shows a cross-sectional elevation view of the socket housing in accordance with an embodiment.

Turning now to FIG. 10, there is shown an interior elevation view of the socket housing 2 in further detail. In this illustration, there is shown the inner surface of the housing 2 comprising opposing bayonet channels 59 each comprising a longitudinal section 60 parallel the coaxial axis and comprising an engagement channel portion 61 substantially transverse the coaxial axis for the insertion and engagement of the opposing laterally projecting engagement pins of a bayonet lightbulb.

As such, the laterally projecting engagement pins of the bayonet lightbulb would be located within the elongate portion 60 of the channel 59 so as to facilitate the downward in-line insertion therein such that, when the end stops 44 of the safety plate 7 engage, the bayonet lightbulb may be rotated slightly such that the engagement pins locate within the engagement channel portion 61.

The safety retention fingers 22 are shown in FIG. 10 as comprising the catches 43 at inner faces thereof.

As can be seen, the upper portions of the safety fingers 22 may be shaped so as to at least partially define the screw-type threading 62 for the screw-type lightbulb. As alluded to above, in embodiments, the safety retention fingers 7 may be integrally formed with the socket housing 2 by comprising a live hinge arrangement at an upper end thereof. In this way, the safety retention fingers 22 are biased inwardly by the live hinge at such that the catches 43 catch underneath the periphery of the safety plate 2 until such time that the fingers 22 are deflected by the deflection wedges 25 of the activation sleeve 24.

As is also shown in FIG. 10, the socket housing 2 may define lateral electrode pogo bore housings 63 and a central electrode pogo bore housing 64.

The foregoing description, for purposes of explanation, used specific nomenclature to provide a thorough understanding of the invention. However, it will be apparent to one skilled in the art that specific details are not required in order to practice the invention. Thus, the foregoing descriptions of specific embodiments of the invention are presented for purposes of illustration and description. They are not intended to be exhaustive or to limit the invention to the precise forms disclosed; obviously, many modifications and variations are possible in view of the above teachings. The embodiments were chosen and described in order to best explain the principles of the invention and its practical applications, they thereby enable others skilled in the art to best utilize the invention and various embodiments with various modifications as are suited to the particular use contemplated. It is intended that the following claims and their equivalents define the scope of the invention.

The invention claimed is:

1. A lightbulb socket comprising:

screw threading for engaging a screw-type lightbulb;

a pair of opposing axial channels for bayonet-type lightbulb pins;

a central and a pair of lateral electrodes, wherein the socket further comprises:

a safety plate having electrode apertures corresponding to the electrodes, the safety plate axially deflectable between a default position where the electrodes are beneath the safety plate and a deflected position wherein the electrodes are exposed through the safety plate;

retention fingers catching the safety plate at the default position, wherein the insertion of a screw-type lightbulb deflects the retention fingers to release the safety plate to the deflected position such that the central electrode is able to electrically contact the screw-type lightbulb;

an axially deflectable sleeve having disengagement wedges, wherein the sleeve is deflected by the insertion of a bayonet lightbulb such that the wedges prise the retention fingers apart from the safety plate to release the safety plate to the deflected position such that the pair of lateral electrodes are able to electrically contact a pair of electrodes of the bayonet lightbulb; and wherein the safety plate comprises twist-lock bi-pin contact engagement formations comprising a pair of major apertures and a pair of corresponding rotationally offset minor apertures for respective receipt and twist-lock engagement of contacts of a twist-lock bi-pin-type light bulb such that the contacts of the twist-lock bi-pin-type lightbulb are able to contact the pair of lateral electrodes.

2. The lightbulb socket as claimed in claim 1, wherein the central and one of the lateral electrodes are electrically connected.

3. The lightbulb socket as claimed in claim 1, further comprising a side electrode exposed within the screw threading for the screw-type lightbulb.

4. The lightbulb socket as claimed in claim 3, wherein a terminus of the side electrode is beneath the safety plate when the safety plate is in the default position.

5. The lightbulb socket as claimed in claim 1, wherein the axial channels terminate in orthogonal transitions for the twist-lock retention of the bayonet lightbulb pins.

6. The lightbulb socket as claimed in claim 1, wherein the safety plate comprises inferior axial guide shafts slidably retained within by guide shaft bores.

7. The lightbulb socket as claimed in claim 6, further comprising compression springs located around the axial guide shafts for biasing the safety plate towards the default position.

8. The lightbulb socket as claimed in claim 6, wherein distal ends of the guide shafts comprise arrowhead engagements for engaging the guide shaft bores.

9. The lightbulb socket as claimed in claim 1, wherein the sleeve comprises inferior axial guide shafts slidably held by guide shaft bores of the safety plate.

10. The lightbulb socket as claimed in claim 9, further comprising compression springs located around the axial guide shafts of the sleeve for biasing the sleeve away from the safety plate.

11. The lightbulb socket as claimed in claim 9, wherein the safety plate comprises lateral formations having the guide shaft bores of the safety plate defined therethrough and wherein the lateral formations are slidably engaged within vertical channels.

12. The lightbulb socket as claimed in claim 1, wherein the retention fingers are elongate and axially orientated, are live hinged at superior ends thereof and comprise inward operative catches at inferior ends thereof.

13. The lightbulb socket as claimed in claim 12, wherein the catches each have horizontal upper surfaces and angled under surfaces.

14. The lightbulb socket as claimed in claim 12, wherein upper regions of the safety fingers define threading formations partially defining the screw threading such that the insertion of the screw-type lightbulb presses against the threading formations to bias the lower ends of the fingers outwardly.

15. The lightbulb socket as claimed in claim 12, wherein each retention fingers comprises a pair of catches.

16. The lightbulb socket as claimed in claim 1, further comprising an insulative divider between the central electrode and one of the lateral electrodes.

17. The lightbulb socket as claimed in claim 1, wherein the electrodes each comprise a pogo pin.

18. The lightbulb socket as claimed in claim 1, wherein the wedges each comprise and inwardly angled wedge face.

19. The lightbulb socket as claimed in claim 1, wherein the sleeve comprises lateral top and bottom travel stop formations.

20. The lightbulb socket as claimed in claim 1, wherein the sleeve comprises a pair of opposing upper edge reliefs aligned with the opposing bayonet pin axial channels for catching the bayonet pins.

21. The lightbulb socket as claimed in claim 20, wherein the reliefs are sufficiently wide so that the bayonet lightbulb can be rotated for engagement without rotating the sleeve.

* * * * *